US005228157A

United States Patent [19]

Johenning et al.

[11] Patent Number: 5,228,157

[45] Date of Patent: Jul. 20, 1993

[54] SOFT-SIDED MATTRESS WITH INTEGRAL FOAM HOOK CONSTRUCTION

[75] Inventors: John B. Johenning, Beverly Hills; James M. Haar, West Los Angeles, both of Calif.

[73] Assignee: Advanced Sleep Products, Carson, Calif.

[21] Appl. No.: 353,532

[22] Filed: May 18, 1989

[51] Int. Cl.[5] ..... A47C 27/08

[52] U.S. Cl. ..... 5/451; 5/917; 5/922

[58] Field of Search ..... 5/451, 452, 450, 400, 5/401, 460, 917, 922

[56] References Cited

U.S. PATENT DOCUMENTS

| | | | |
|---|---|---|---|
| 4,506,397 | 3/1985 | Fogel et al. | 5/451 |
| 4,602,396 | 7/1986 | Fraige | 5/451 |
| 4,745,646 | 5/1988 | Strobel | 5/451 |

*Primary Examiner*—Alexander Grosz

*Attorney, Agent, or Firm*—Calfee, Halter & Griswold

[57] ABSTRACT

A mattress construction includes a water mattress and a resilient peripheral cushion extending about the water mattress. A flexible cover is positioned on the resilient cushion, with the resilient cushion including a peripheral inner rail and a peripheral outer rail, the interior surface of the inner rail providing peripheral support for the water mattress. The inner and outer rails are interengaged whereby the inner rail resists upward movement of the outer rail.

2 Claims, 3 Drawing Sheets

Fig. 3.
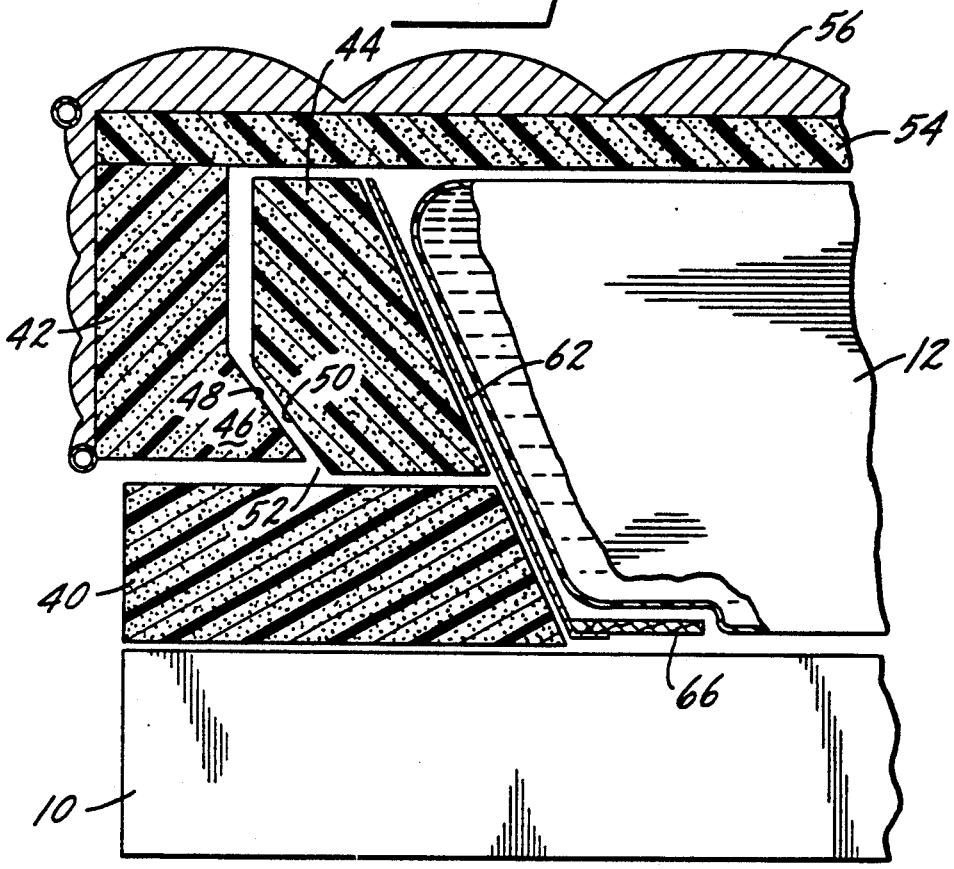
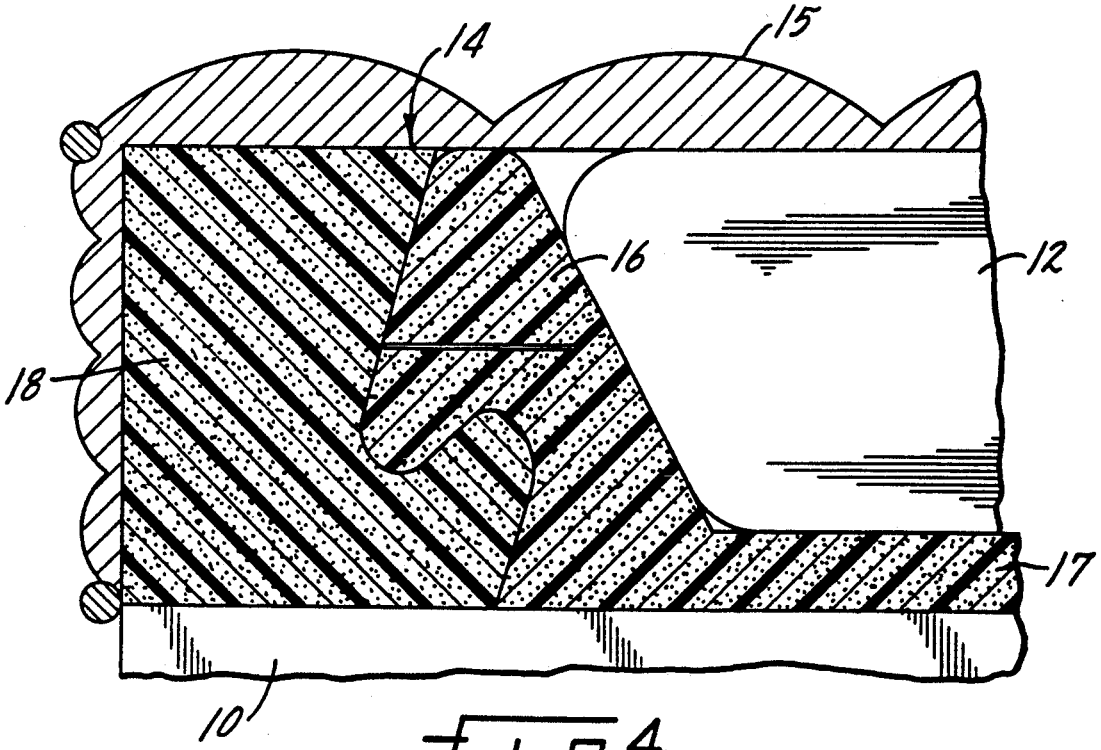
Fig. 4.

SOFT-SIDED MATTRESS WITH INTEGRAL FOAM HOOK CONSTRUCTION

SUMMARY OF THE INVENTION

The present invention relates to a waterbed mattress construction in which there is a resilient cushion forming the peripheral support for the water mattress and in which portions of the resilient cushion are interlocked together to prevent the cushion and its overlying cover from pulling up when a person sits on the side or lies upon the waterbed, thereby insuring that the sides of the mattress construction retain their initial vertical configuration.

One purpose of the invention is a mattress construction in which the soft-sided peripheral support for the water mattress consists of inner and outer rails which are interlocked together, preventing one portion of the rail assembly from lifting up when a person sits on another portion.

Another purpose is a simply constructed reliable soft-sided waterbed mattress peripheral support which is held down by the weight of the water in the mattress and which has an easily removed exterior cover.

Another purpose is an improved water mattress construction including a sculpted soft-sided frame formed of two separate pieces interlocked one to another to resist upward movement of any portion of the frame.

Another purpose is an improved soft-sided water mattress support frame having inner and outer peripheral sections, with the inner section including an integral base.

Other purposes will appear in the ensuing specification, drawings and claims.

BRIEF DESCRIPTION OF THE DRAWINGS

The invention is illustrated diagrammatically in the following drawings wherein:

FIG. 3 is an enlarged cross section through a modified water mattress construction with the parts slightly separated for clarity of illustration, FIG. 4 is an enlarged cross section, similar to FIG. 2, but showing a further modified water mattress construction.

DESCRIPTION OF THE PREFERRED EMBODIMENT

The present invention relates to a water mattress construction in which a water mattress, which may be one, two or more water containers, is peripherally supported by a resilient cushion. In some applications the water containers may contain a suitable baffling structure, for example as shown in U.S. Pat. No. 4,467,485. The resilient cushion, which extends peripherally about the water mattress, is formed of an inner rail and an outer rail. These two rails are interlocked together and may have a fabric quilted cover. The water mattress and soft-sided rails may sit on a foundation or frame.

In prior waterbed constructions using a soft-sided cover, if a person sits on the edge of the cover, adjacent areas of the cover pull up and away from the underlying foundation. Over a period of time the walls of the resilient cover tend to bow out, either along the top or bottom, and the mattress sides do not retain their original vertical appearance. By interlocking the inner and outer rails of the resilient cover, and by using pressure from the water mattress to hold down the inner rail, the cover will not pull up and it will retain its original vertical appearance over the life of the water mattress. The cover and outer rail are, however, easily removed to obtain access to the water container.

Figure 1:
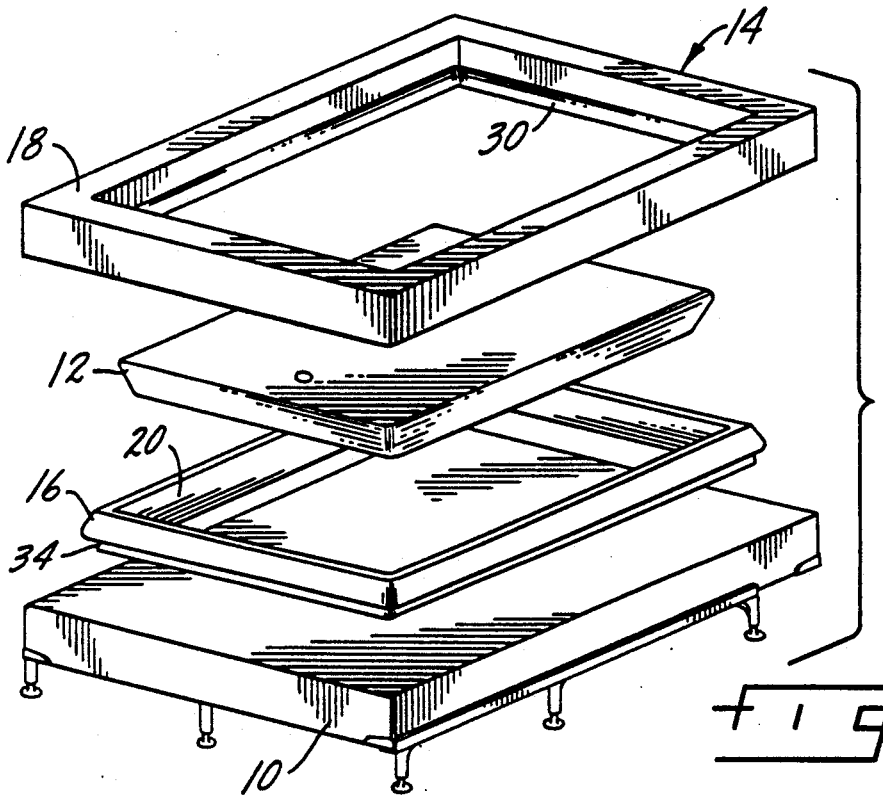
FIG. 1 is an exploded perspective illustrating the improved water mattress construction of the present invention.

In FIG. 1, a waterbed foundation is indicated at 10 and may be a typical box configuration supported by a plurality of feet. Positioned on foundation 10 is a water container 12 and a soft-sided peripheral support 14. A quilted cover 15 may overlie the soft-sided support and the water mattress, as particularly shown in FIG. 2.

The soft-sided support 14 may include a peripheral inner rail 16 and a peripheral outer rail 18, both of which are formed from a resilient foam material. Inner rail 16 has an interior slanted surface 20 which slants from the outside toward the inside and peripherally supports the water container 12. The water container will apply downward pressure or load upon inner rail 16 so that the rail is held down on foundation 10. Water container 12 may extend the full depth of the cavity formed by the soft-sided support 14 or it may have a depth less than that of the cavity, in which case there may be a foam pad positioned within the cavity and beneath the water container, as illustrated in FIGS. 4–7.

Outer rail 18, which has a height the same as that of the inner rail, and when interlocked to the inner rail as described herein, forms the resilient soft-sided support for the water container, has an exterior vertical wall 22 and a top wall 24. The bottom wall 26 of the outer rail is coextensive with the bottom wall 28 of the inner rail.

Figure 2:
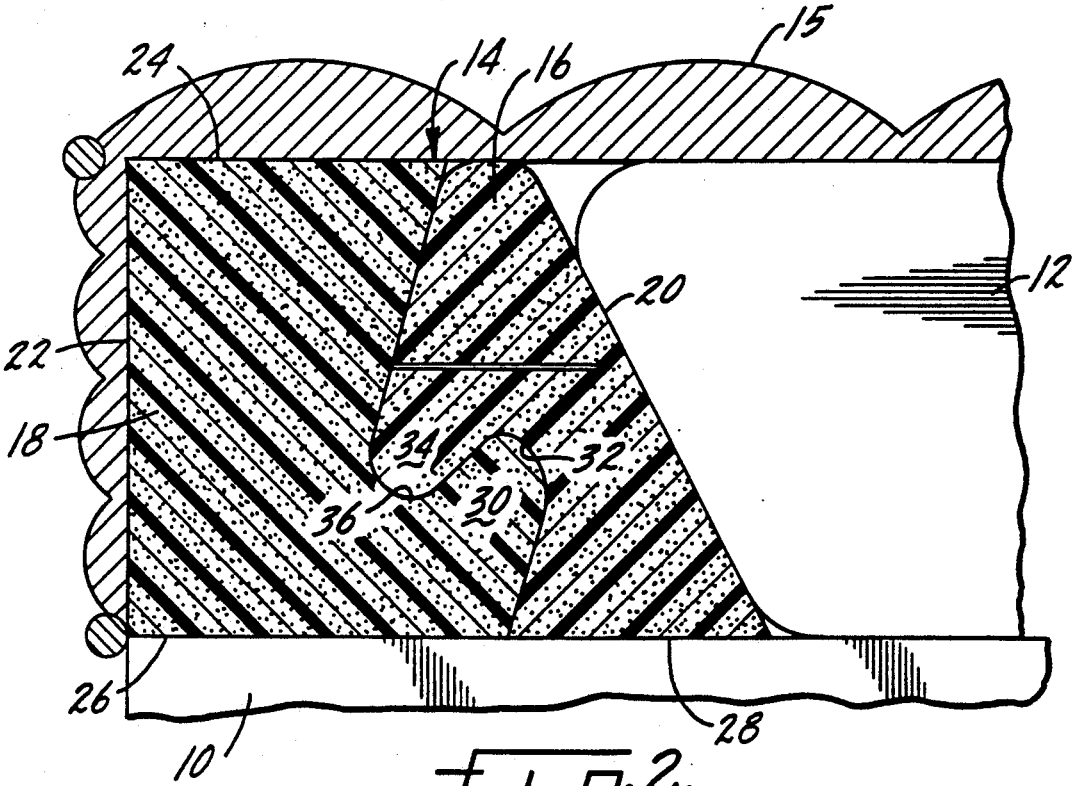
FIG. 2 is an enlarged cross section through the water mattress construction of FIG. 1.

The inner and outer rails have mating interlocking facing surfaces. As illustrated in FIG. 2, these surfaces are curvilinear, although they could be otherwise, and the outer rail 18 has an inwardly-extending interior projection 30 which extends into a cavity 32 in the inner rail such that projection 30 extends inwardly of and beneath inner rail 16. In like manner, inner rail 16 has an outwardly-extending projection 34 which extends within a cavity 36 of the outer rail. The mating curvilinear surfaces and the projections and cavities described interlock the inner and outer rails together and resist or prevent upward movement of the outer rail relative to the inner rail unless the outer rail projection 30 is first released from cavity 32.

Downward pressure applied by the weight of the water container keeps the inner rail on the foundation. Since the outer rail is interlocked to the inner rail and cannot be pulled directly upward from it, the outer rail cannot pull up when a person sits on one part of it. The vertical configuration of the soft-sided cushion is retained over the life of the mattress construction.

Cover 15 is flexible and quilted and may be attached to the outer rail in any suitable manner. Although the outer rail will not raise up when a person sits on it, it can be released, with the cover, by pulling it laterally away from the inner rail.

The embodiment of the invention in FIG. 4 is the same as illustrated in FIG. 2, except that inner rail 16 has an integral bottom or base 17 which extends beneath the water mattress 12. Thus, the depth of the cavity for the water mattress, and the depth of the water mattress, is reduced over that illustrated in FIG. 2. The integral base provides further load on the inner rail to assist in its function of maintaining the vertical configuration of the mattress.

In the embodiment of FIG. 3, seated on frame 10 is a peripheral rigid platform 40 which may, for example, be polystyrene foam and which supports the soft-sided mattress construction consisting of outer rail 42 and inner rail 44, both of which are formed of a suitable resilient foam material. Outer rail 42 has an inwardly-extending hook or projection 46 which has an upwardly-facing slanted wall 48 which mates with a downwardly-facing slanted wall 50 of a peripheral recess 52 formed at the bottom of inner rail 44. Thus, the inner and outer rails are again interlocked together through the mating interengaging surfaces thereof.

A resilient top foam pad 54 may be peripherally glued or otherwise attached to the top of outer rail 42 and may overlie the inner rail as well as the water container. A quilted cover 56 may be attached to the outer rail and pad 54.

Positioned between the exterior periphery of the water container 12 and the inner surfaces of the inner rail and platform 40 is a layer of fabric 62 which may in some applications extend over the top of inner rail 44. Fabric 62 is glued or otherwise attached to the inner surface of the inner rail. A peripheral rigid support 66, for example of wood, is glued or otherwise attached to the bottom of fabric layer 62 and is positioned beneath the water container. The fabric layer, glued to the inner rail and fixed to support 66, thus holds the inner rail in position on platform 40 and frame 10, not only by pressure from the water container directly on the inner rail, but also by the weight of the water on the peripheral support 66. Support 66 may be glued or otherwise attached to the foundation 10, but this is not necessary, as in some applications the weight of the water container itself is sufficient. In some applications, support 66 may extend over the entire bottom of the water container cavity, whereas, in other applications it may be only peripheral. What is important is that support 66 be beneath the water container and be attached to fabric layer 62 to thereby hold the inner rail down upon the foundation.

Figure 5:
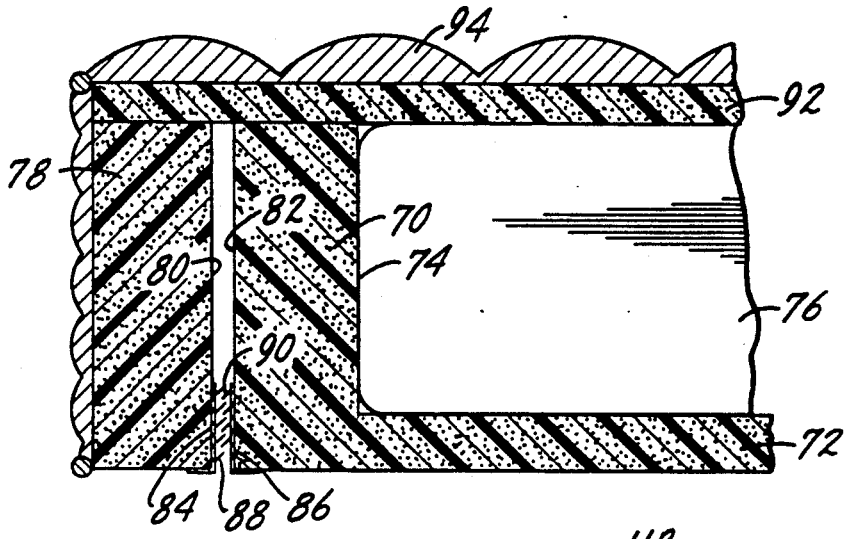
FIG. 5 is a cross section of yet a further embodiment of the invention illustrating a modified water mattress construction.

In the embodiment of FIG. 5, an inner rail 70 has an integral bottom or base 72 which together define a cavity 74 within which is positioned a water mattress 76. Both the interior wall and the exterior wall of inner rail 70 are generally vertical. Positioned peripherally about inner rail 70 is an outer rail 78 which may have a generally vertical inner face 80 which faces the generally vertical outer face 82 of the inner rail 70. As in all forms of the invention, both the inner and outer rails, and in this case base 72, are formed of a resilient foam material.

Attached adjacent the bottom of the inward facing surface 80 of outer rail 78 is a small plastic extrusion 84 which extends upwardly along face 80 and for a short distance along the bottom of outer rail 78. Facing the extrusion 84 is an extrusion 86 which is similarly attached to the outward facing wall 82 of inner rail 70. Extrusions 84 and 86 each have a plurality of teeth or projections, with the teeth 88 on extrusion 84 facing upwardly and the teeth 90 on extrusion 86 facing downwardly. Thus, when the inner and outer rails are joined together, the interlocking teeth 88 and 90 will prevent upward vertical movement of outer rail 78 relative to inner rail 70. However, the teeth can be disengaged by an outward pull of the outer rail, thus permitting the outer rail to be removed for access to the water mattress cavity 74.

The embodiment of FIG. 5 has a top foam cushion 92 which is attached to the outer rail and overlays the inner rails. A quilted cover 94, the same as in the other forms of the invention, completes the structure.

Figure 7:
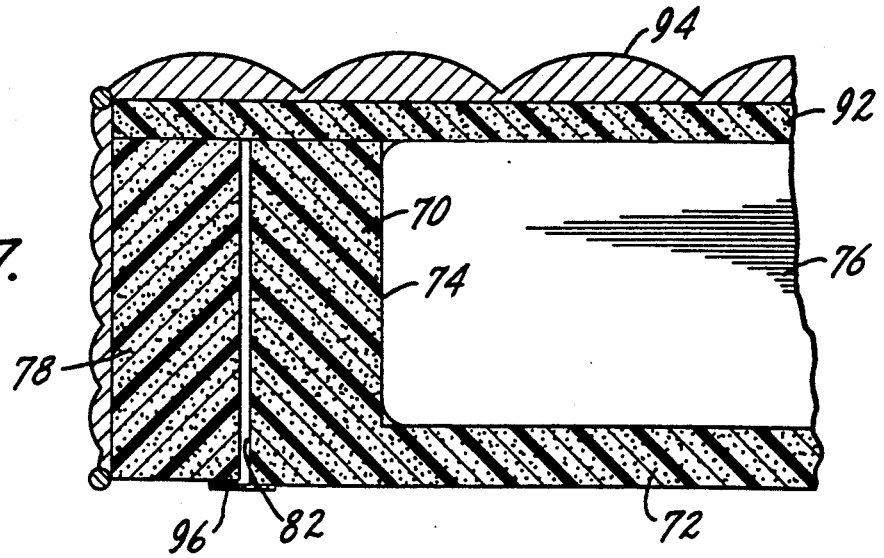
FIG. 7 is a further cross section through a further modified water mattress construction.

The embodiment of FIG. 7 is similar to that shown in FIG. 5, with the exception of the means for joining the inner and outer rails to prevent upward vertical movement of the outer rail. Like numbers have been given to like parts. In the FIG. 7 embodiment, attached to the bottom of inner rail 70 adjacent its upward vertical face 82, is one portion of a hook and loop fastening means indicated at 96. Velcro is a typical material which may be used for the hook and loop fasteners. The hook and loop fastener 96 has a portion attached to both inner rail 70 and outer rail 78, with the result that the outer rail will not move vertically upward when a person sits or lies on the edge of the water mattress from the inner rail. However, the outer rail can be released by a pull sufficient to overcome the adhesion of the hook and loop fasteners.

Figure 6:
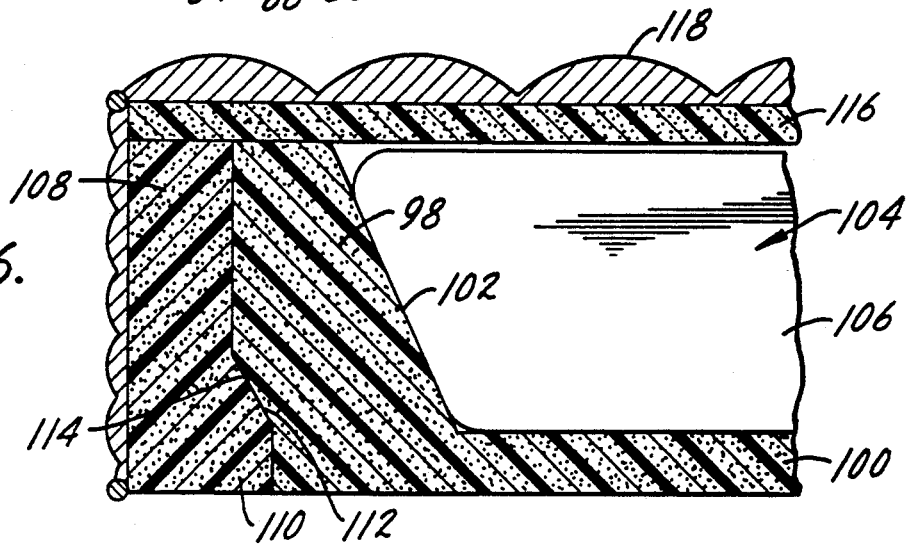
FIG. 6 is a cross section of an additional embodiment of the invention illustrating a modified water mattress construction.

In the FIG. 6 embodiment, an inner rail 98 having an integral bottom or base 100 has a slanted inner wall 102 which defines a cavity 104 for a water mattress 106. An outer rail is indicated at 108 and has an inwardly-directed projection 110 with an inwardly facing slanted wall 112. The exterior of inner rail 98 has a mating slanted surface 114 so that the inner and outer rails may be interlocked in a manner to prevent upward movement of the outer rail relative to the inner rail. The embodiment of FIG. 6 is similar to that of FIG. 3, except that the projection on the outer rail is of less inward extension, providing economies in manufacture. As in the FIGS. 5 and 7 embodiments, there is an upper cushion 116 which overlies both the inner and outer rails and a quilted cover 118.

In the FIG. 5, 6 and 7 embodiments, and in the FIG. 3 embodiment, the quilted cover and the upper foam layer and the outer rail may be formed into a single unit which in effect is a cover for the water mattress construction. Removal of the cover permits access to the water mattress within the inner rail cavity.

In all forms of the invention the soft-sided peripheral support for the water container is peripherally held down on the foundation and thus is unable to lift up when a person sits on any part of the periphery of the water mattress. The weight of the water container applies downward pressure on the inner rail and the inner and outer rails are locked together, thereby resisting any upward movement of the soft-sided support when a person sits on it. The outer rail and its attached cover may be removed from the held-down inner rail by pulling laterally to thereby obtain access to the water container.

Whereas the preferred form of the invention has been shown and described herein, it should be realized that there may be many modifications, substitutions and alterations thereto.

The embodiments of the invention in which an exclusive property or privilege is claimed are defined as follows:

1. In a mattress construction, a water mattress, a resilient peripheral cushion extending about said water mattress, a flexible cover for said resilient cushion, said resilient cushion including a peripheral inner rail and a peripheral outer rail, the interior surface of the inner rail providing a peripheral support for said water mattress, said inner rail including an integral base supporting said water mattress, said inner and outer rails including facing generally vertical surfaces and cooperative, interengaging means on each of said generally facing vertical surfaces, interlocking said surfaces thereby preventing relative vertical movement between said inner and outer rails, said interlocking means including hook and loop fastener strips.

2. In a mattress construction, a water mattress, a resilient peripheral cushion extending about said water mattress, a flexible cover for said resilient cushion, said resilient cushion including a peripheral inner rail and a peripheral outer rail, the interior surface of the inner rail providing a peripheral support for said water mattress, a base integral with said inner rail and providing bottom support for said water mattress, said inner and outer rails having facing generally vertical surfaces, and means adjacent the lower end of said surfaces for interlocking the inner rail to the outer rail and preventing relative vertical movement therebetween, said interlocking means including hook and loop fasteners strips adjacent the lower end of said inner and outer rails.

* * * * *